United States Patent [19]

Sanchez

[11] Patent Number: 4,866,901

[45] Date of Patent: Sep. 19, 1989

[54] DETERIORATED EAVEPOST REPAIR APPARATUS FOR HOUSES HAVING SAME

[76] Inventor: Alfredo G. Sanchez, 12361 E. Thunderhead Ranch Rd., Tucson, Ariz. 85747

[21] Appl. No.: 123,556

[22] Filed: Nov. 20, 1987

[51] Int. Cl.[4] ..... E04G 23/00

[52] U.S. Cl. ..... 52/514; 52/233; 52/745; 52/728

[58] Field of Search ..... 52/311, 313, 233, 514, 52/727, 728, 745

[56] References Cited

U.S. PATENT DOCUMENTS

| | | | |
|---|---|---|---|
| 1,758,046 | 5/1930 | Ilson | 52/233 |
| 1,841,127 | 1/1932 | Ilson | 52/313 |
| 2,450,345 | 9/1948 | Kervin | 52/728 |
| 3,075,358 | 1/1963 | Becker et al. | 61/53 |
| 3,300,940 | 1/1967 | Golasz | 52/727 |
| 3,410,097 | 11/1968 | Young | 61/53 |
| 3,448,585 | 6/1969 | Vogelsang | 61/54 |
| 3,514,959 | 6/1970 | Dougherty, Jr. | 61/53 |
| 4,245,931 | 1/1981 | Watts, Jr. | 52/301 |
| 4,288,954 | 9/1981 | O'Donnell | 52/233 |
| 4,320,610 | 3/1982 | Rupp | 52/233 |
| 4,433,519 | 2/1984 | Jenkins | 52/233 |
| 4,619,089 | 10/1986 | Stein | 52/233 |
| 4,627,204 | 12/1986 | Smith | 52/233 |
| 4,718,213 | 1/1988 | Butterfield | 52/313 |

*Primary Examiner*—David A. Scherbel
*Assistant Examiner*—Caroline D. Dennison
*Attorney, Agent, or Firm*—Victor Flores; Harry M. Weiss

[57] ABSTRACT

Apparatus and method for repair of deteriorated eaveposts on houses having eaveposts. The apparatus consists of an elongated, tubular body with an end cap and a mounting flange. The apparatus slips over the deteriorated eavepost and attaches to the house with conventional fasteners. The body and end cap of the apparatus are textured to resemble the texture of an intact wooden eavepost and the mounting flange is textured to resemble the texture of the exterior wall of the house.

3 Claims, 1 Drawing Sheet

DETERIORATED EAVEPOST REPAIR APPARATUS FOR HOUSES HAVING SAME

FIELD OF THE INVENTION

The present invention generally relates to repairing deteriorated eaveposts on houses having eaveposts and, more particularly, in concerned with apparatus and method for covering deteriorated eaveposts to resemble an original eavepost.

DESCRIPTION OF THE PRIOR ART

Eaveposts on houses are exposed to the elements and are subject to weathering and deterioration. The ends of the posts frequently become broken, split, or chipped. Replacement of the eaveposts is difficult and expensive because the posts is either the end of a structural member of the house or because the post is attached within the exterior wall.

Eaveposts are common architectural elements in the southwestern style and are known as vigas. These posts are generally of unfinished wood and exposed to intense sunshine and heavy rains. In older southwest homes, the exposed ends are the ends of the beams which support the ceiling and the roof; replacement is extremely difficult and expensive.

Prior art reveals other methods of capping posts. One method is described and illustrated in U.S. Pat. No. 3,075,358 to A. E. Becker et al. A cap provided with a special bead or lug configuration is screwed onto concrete piling tubing to provide an improved form for concrete pilings.

Another method is described and illustrated in U.S. Pat. No. 3,410,097 to E. M. Young. A mechanism is provided to rehabilitate old piles and protect new piles by capping the piles with cement. However, the apparatus is used in a vertical position and does not produce a cap having an appearance resembling an intact wooden pile.

A third method is described and illustrated in U.S. Pat. No. 3,448,585 to R. G. Vogelsang. Heat shrink tubing is used to seal and protect sections of piles and posts. However, the method does not repair damaged or deteriorated posts and does not produce a cap having an appearance resembling an intact wooden post.

An additional method is described and illustrated in U.S. Pat. No. 3,514,959 to J. J. Dougherty, Jr. A shoe for the bottom of timber piles is formed from a flat body having peripheral wings bent around the side surface of the pile and attached through a central hole in the flat surface.

A fifth method is described and illustrated in U.S. Pat. No. 4,245,931 to R. Watts, Jr. This method caps a post with an outer cover which is filled with closed-cell foamed resin. This method does not provide a cap having an appearance resembling an intact wooden post.

Consequently, a need exists for an apparatus and method to cap deteriorated eaveposts in a horizontal or nearly horizontal position and to produce a finished cap having the appearance of an intact eavepost.

SUMMARY OF THE INVENTION

The present invention provides a method and apparatus for repairing eaveposts on houses having eaveposts in a horizontal or nearly horizontal position and is designed to produce a repaired eavepost which resembles an original, intact eavepost in texture and appearance.

The present invention relates to a method and apparatus for capping deteriorated eaveposts with an apparatus consisting of an extended body, an end cap, and a mounting flange. The method consists of providing an apparatus which slips over the deteriorated post, which resembles the texture and appearance of original posts, and which attaches to the house by conventional means.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

DESCRIPTION OF THE PREFERRED EMBODIMENT

Figure 2:
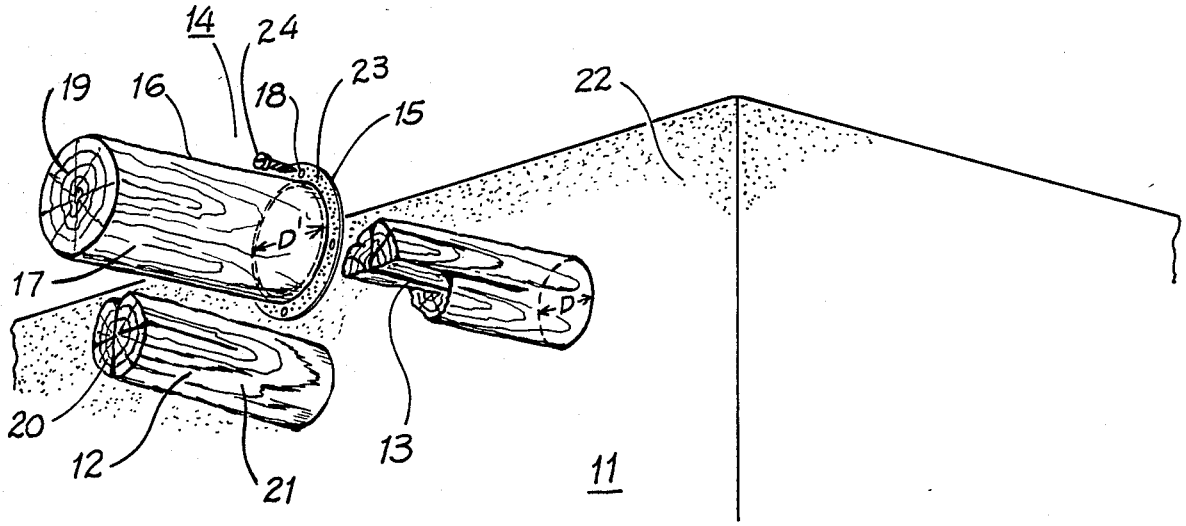
FIG. 2 is an enlarged perspective view of a deteriorated eavepost and of the repair apparatus of the present invention.

Referring now to the drawings, and more particularly to FIG. 2, there is shown a repair apparatus, generally designated 14, which comprises the preferred embodiment of the invention. The apparatus includes an elongated body 16, and end cap 19, and a mounting flange 15.

Figure 1:
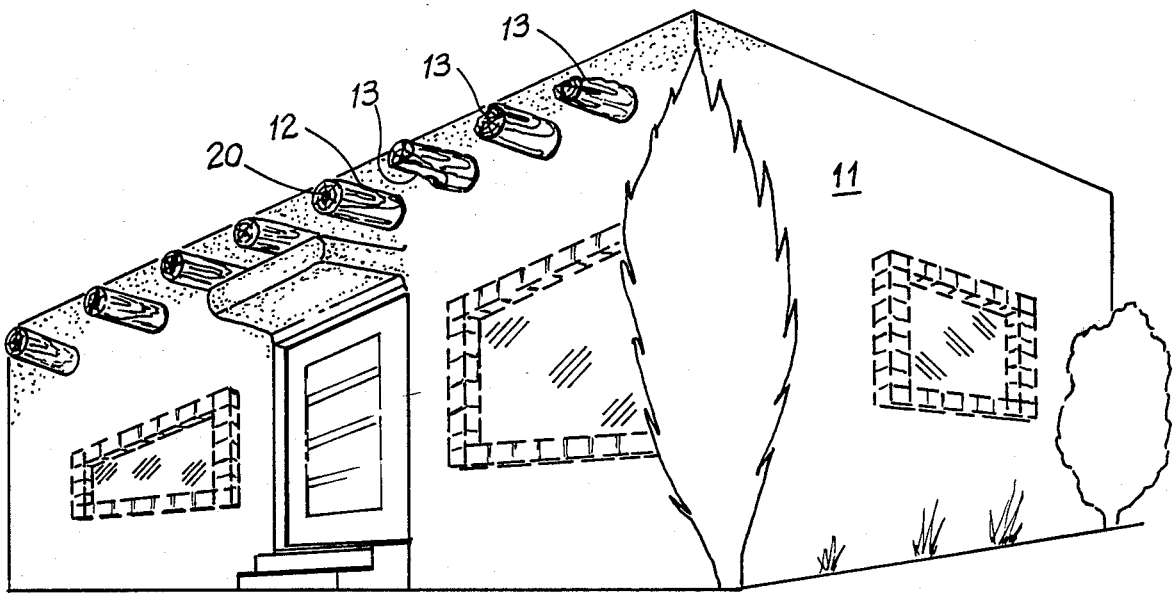
FIG. 1 is a side elevational view of a home in the southwest style having exposed eaveposts which have deteriorated.

As seen in FIG. 1, houses in the southwest style 11, have exposed, wooden eaveposts 12, called vigas, which have intact, round, wood ends 20. Exposure to the elements results in cracked, broken, and chipped eaveposts 13.

FIG. 2 shows the preferred embodiment of the invention which provides a method for slipping a repair apparatus 14 over a deteriorated eavepost 13. The repair apparatus 14 consists of an elongated tubular body 16, which has a wood grain appearance 17 resembling that of an intact eavepost 21 and which has a length only nominally longer than that of an intact eavepost 12. The interior diameter D' of the tubular body 16 is minimally larger than the exterior diameter D of the eavepost being repaired 13. An end cap 19 is attached to the tubular body 16 and has a wood grain appearance 19 which resembles the appearance of the end of an intact eavepost 20.

The repair apparatus 14 has a round mounting flange 15 having holes 18 through which the apparatus 14 is attached to the house 11 by conventional means 24. The mounting flange 15 has a texture 23 which resembles the texture of the exterior wall of the house 22.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A deteriorated eavepost repair apparatus for a house having deteriorated eaveposts, comprising:

(a) an elongated body, said elongated body having a shape and appearance resembling the shape and appearance of an original eavepost said elongated body being a tubular body having a diameter, length, and wood grained appearance resembling the diameter, length, and wood grained appearance of an original eavepost;

(b) an end cap, said end cap being attached to said elongated body and a shape and appearance resembling the shape and appearance of an end of an original eavepost, said end cap includes being integrally attached to said elongated body said end cap includes being a round disc having a diameter and a wood grained appearance resembling the diameter and wood grained appearance of the end of an original eavepost;

(c) a mounting flange, said mounting flange being attached to said elongated body and being provided with means for attaching to said house having deteriorated eaveposts being a flat ring having holes for fixedly mounting to said house, said mounting flange being provided with a surface texture resembling the exterior texture of said house.

2. A deteriorated eavepost repair apparatus for houses having deteriorated eaveposts, comprising:

(a) a tubular body having a diameter, length, and wood grained appearance resembling the diameter, length, and wood grained appearance of an original eavepost;

(b) a round end cap integrally attached to said tubular body and having a diameter and a wood grained appearance resembling the diameter and wood grained appearance of the end of an original eavepost;

(c) a round mounting flange integrally attached to said tubular body and having a flat ring provided with holes for fixedly mounting to said houses and a surface texture resembling the exterior texture of said houses.

3. A method of capping deteriorated eaveposts on houses having same, comprising the steps of:

(a) providing an apparatus for covering deteriorated eaveposts, said apparatus includes:

(i) a tubular body having a wood grained texture resembling that of an intact eavepost;

(ii) an end cap integrally attached to said tubular body, said end cap having a wood grained texture resembling that of the end of an intact eavepost; and (iii) a mounting flange integrally attached to said tubular body, said mounting flange having a texture resembling that of said house;

(b) slipping said apparatus over the deteriorated eavepost;

(c) attaching said apparatus to said houses using said mounting flanges.

* * * * *